United States Patent [19]

Hayashi

[11] 4,109,774

[45] Aug. 29, 1978

[54] CONTROL SYSTEM FOR A VENDING MACHINE

[75] Inventor: Yukichi Hayashi, Sakado, Japan

[73] Assignee: Nippon Coinco Co., Ltd., Japan

[21] Appl. No.: 746,804

[22] Filed: Dec. 2, 1976

[30] Foreign Application Priority Data

Dec. 5, 1975 [JP] Japan ..... 50/145277

[51] Int. Cl.[2] ..... G07F 1/02

[52] U.S. Cl. ..... 194/1 C; 194/DIG. 20; 194/DIG. 15; 133/1 R; 133/8 R

[58] Field of Search ..... 133/1 R, 2, 8 R; 194/1 C, 1 D, 1 G, 1 L, 1 M, 1 N, 1 R, 10, DIG. 15, 1 E, DIG. 1, DIG. 2, DIG. 20

[56] References Cited

U.S. PATENT DOCUMENTS 2,974,772 3/1961 Zeigle et al. ..... 133/2 X 3,703,229 11/1972 Bowring ..... 194/1 N X 3,805,936 4/1974 Jensen ..... 194/DIG. 15

*Primary Examiner*—Robert B. Reeves

*Assistant Examiner*—Joseph J. Rolla

[57] ABSTRACT

A control system for a vending machine of a type capable of vending plural pieces of an article continuously in which an upper limit number of coins to be accepted is set for every denomination of coin and, if the number of inserted coins has reached the set upper limit, a subsequently inserted coin of the particular denomination is returned without being accepted. The control system according to the invention includes a counting device provided for each denomination of coin and a circuit for comparing the counting output of each counting device with a predetermined upper limit coin number for the corresponding denomination.

5 Claims, 1 Drawing Figure

CONTROL SYSTEM FOR A VENDING MACHINE

Figure 1:
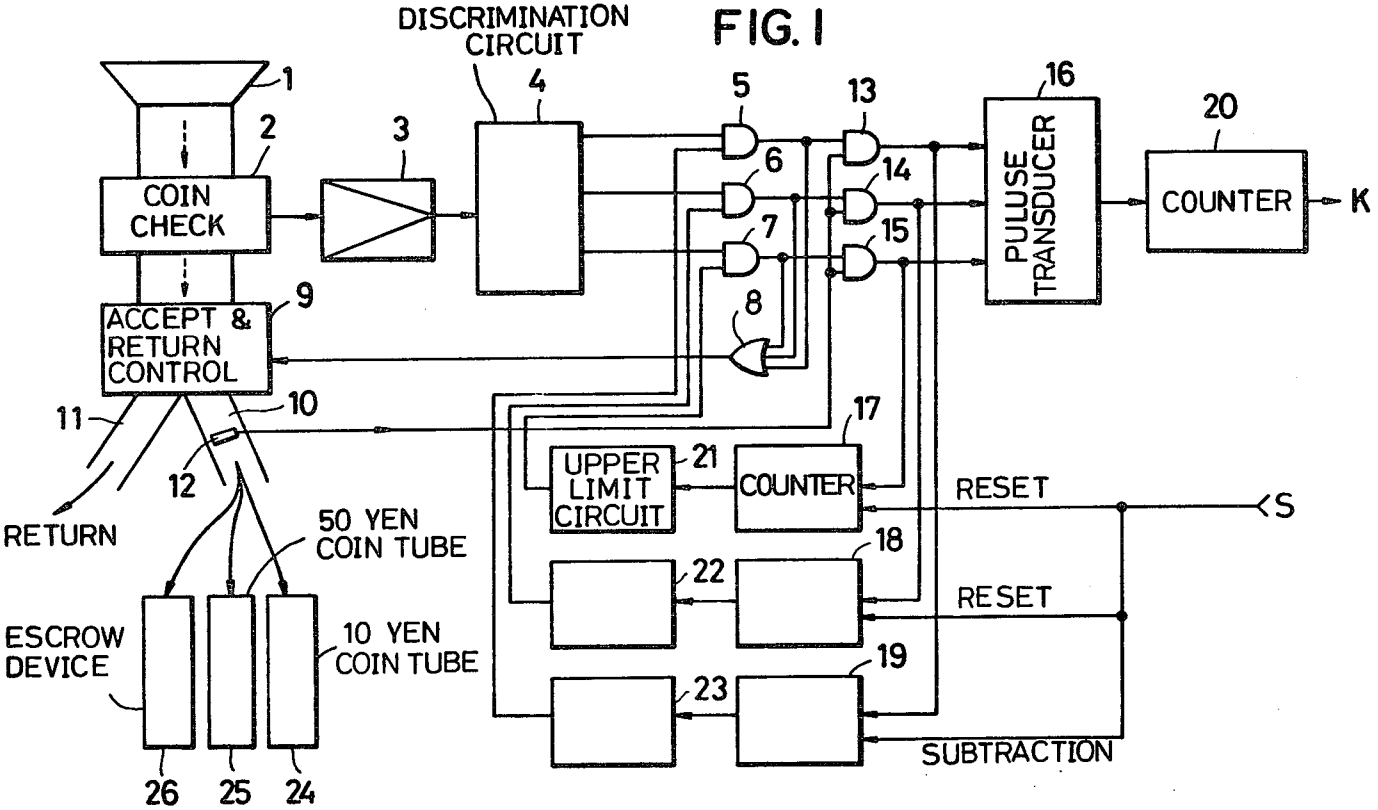

This invention relates to a control system for a vending machine and, more particularly, to a control system imposing restriction on the number of coins inserted into a vending machine which is capable of vending plural pieces of an article continuously.

In purchasing from a vending machine of a type wherein plural pieces of an article can be vended continuously, the purchaser of such plural pieces of article sometimes cannot estimate an exact number of coins to be inserted into the vending machine for a single series of purchase. If the purchaser wishes to purchase a large number of pieces of the article at a time, he will insert many coins, whereas if he wants only one or a few pieces, he will insert a small number of coins. However, there is a limit in the total quantity of article which can be stored in the vending machine. There is also a limit in the amount of money which can be paid out as a change or which can be retained temporarily in an escrow device of the vending machine. It is, accordingly, necessary in this type of vending machine to restrict the number of coins to be accepted when the number of coins inserted has reached a certain number without accepting inserted coins limitlessly. In this case, restriction should be imposed not on the basis of the total amount of inserted coins but by the kind of denomination of the inserted coins, for it is convenient in a vending machine to treat coins differently according to their denominations (e.g. retaining temporarily a high denomination coin such as 100 yen). In a vending machine of a type wherein only a single piece of article can be vended, the above problem does not take place but it is only necessary to restrict acceptance of inserted coins if the amount of inserted coins exceeds a maximum amount of change (e.g. 90 yen).

It is, therefore, an object of the present invention to provide a control system for a vending machine of a type capable of vending plural pieces of an article continuously which control system is capable of rejecting acceptance of newly inserted coins of any denomination when the number (or the amount) of the already inserted coin of that denomination has reached a certain predetermined upper limit value.

A preferred embodiment of the invention will now be described with reference to the accompanying drawing in which FIG. 1 is a block diagram showing the preferred embodiment.

In FIG. 1, a coin inserted from a coin slot 1 is led to a coin checking unit 2 in which whether the inserted coin is a true coin or a false one is checked and the denomination of the coin is identified. As the coin checking unit 2, an electronic type of checking device such as disclosed in the specification of German Patent Application No. P 2133725.7 filed July 7, 1971 may be used. The output of the coin checking unit 2 is applied to a discrimination circuit 4 via an amplifier 3. The discrimination circuit 4 supplies a signal "1" to an AND gate 5 if the inserted coin is a 100-yen true coin, to an AND gate 6 if the inserted coin is a 50-yen true coin and to an AND gate 7 if the inserted coin is a 10-yen true coin, respectively. The other inputs of the AND gates 5–7 will be described in detail later but let us assume that they are now a signal "1". The signal "1" delivered out of one of the AND gates 5–7 for the denomination of the inserted coin is applied to an accept-return control solenoid 9 via an OR gate 8 to energize the solenoid 9 and thereby introduce the inserted coin to a true coin path 10. If the coin checking unit 2 has detected a false coin, the solenoid 9 is not energized and the false coin is introduced to a return path 11. There is provided a coin detection switch 12 in the true coin path 10. When the coin actuates the switch 12, a signal "1" is applied to AND gates 13, 14 and 15 to enable them. In other words, the switch 12 confirms that a true coin has been received in the true coin path 10 and thereupon enables the AND gates 13–15. Since either one of the AND gates 5–7 has already produced an output "1" upon receipt of the true coin detection signal for the corresponding denomination, a corresponding one of the AND gates 13–15 produces an output signal "1". This output signal "1" is applied to a pulse transducer 16 as a true coin acceptance pulse of the particular denomination. Simultaneously, the output pulse is applied to a 10-yen coin insertion number counter 17 if the output pulse is one from the AND gate 15, to a 50-yen coin insertion number counter 18 if the output pulse is one from the AND gate 14, and to a 100-yen coin insertion number counter 19 if the output pulse is one from the AND gate 13.

The pulse transducer 16 produces a pulse representative of the amount of the inserted coin and supplies it to a main counter 20. The main counter 20 adds the amounts of the inserted coins together. As is already known, the counted content K of the main counter 20 is compared with a set vend price of a desired article in a comparator (not shown) for determining whether the article can be vended or not. Further, the set vend price of the vended article is subtracted from the amount of the inserted coin or coins.

The 10-yen coin counter 17, the 50-yen coin counter 18 and the 100-yen coin counter 19 respectively count the number (i.e. the amount) of the inserted coins by each denomination. A signal representing the counted number of coins for each denomination is applied to a corresponding one of a 10-yen coin number upper limit circuit 21, a 50-yen coin number upper limit circuit 22 and a 100-yen coin number upper limit circuit 23 which detect whether the number of the inserted coins has reached a predetermined upper limit number or not. The upper limit circuits 21–23 output a signal "1" until the number of the inserted coins reaches the upper limit thereby enabling the AND gates 5–7 of the corresponding denominations. When the upper limit circuits 21–23 have detected the upper limit number, they output a signal "0" thereby disenabling the corresponding AND gates 5–7. Accordingly, when the number of the inserted coins of a certain denomination has reached the upper limit, the output of the OR gate 8 thereafter is "0" even if a true coin of the same denomination is further inserted. Consequently, the accept-return control solenoid 9 is not energized and the inserted coin is introduced into the return path 11.

The upper limit set in the respective upper limit circuit 21–23 differs for the kind of denomination. The upper limit of the 10-yen coin number upper limit circuit 21, for example, may be set at 31 10-yen coins, the upper limit of the 50-yen coin number upper limit circuit 22 at 15 50-yen coins and the upper limit of the 100-yen coin number upper limit circuit 23 at 7 100-yen coins. The upper limit circuits 21–23 may be composed of, for example, a digital type comparator.

When a plurality of coins have been thrown in and an initial vend has been made (i.e. a piece of the desired article has been delivered), a vend signal S becomes a signal "1" representing that vend has been made. This vend signal S is applied to reset inputs of the 10-yen counter 17 and the 50-yen counter 18 to clear the counted contents (stored contents) of these counters 17 and 18. The vend signal S is also applied to the 100-yen counter 19 to bring the counter 19 into a subtraction mode. The accepted 10-yen and 50-yen coins are stored in a 10-yen storage tube 24 and a 50-yen storage tube 25 respectively, whereas 100-yen coins are temporarily retained in an escrow device 26. The escrow device 26 receives 100-yen coins of a number corresponding to the vend price of the article whenever a single vend (i.e. vending of one piece of the article) is made. The number of 100-yen coins thus received in the escrow device 26 is subtracted from the content of the counter 19 which is in a subtraction mode. Control concerning the subtraction operation however will not be described in detail because it is not an essential portion of the invention.

Since the counters 17 and 18 are reset and subtraction is made from the content of the counter 19 each time a single piece is vended in the course of a continuous vending of plural pieces of the article, the outputs of the upper limit circuits 21–23 return to "1" whereby the AND gates 5–7 are enabled with the result that insertion of additional coins during the vending operation is made possible.

In the above described embodiment, the 10-yen coin counter 17 and the 50-yen coin counter 18 are reset by the vend signal S. Alternatively, the counters 17 and 18 may be brought into a subtraction mode by the vend signal S so that the vend price of the article may be subtracted from the contents of the counters.

What is claimed is:

1. In a vending machine capable of vending plural pieces of one or more articles in a single series of vending operations, means for separately accepting coins of plural denominations and a control system, said control system comprising:

a plurality of counter means for counting the number of inserted coins by denomination;

a plurality of upper limit number detection means for detecting whether or not the number of coins counted by said counter means of the corresponding denomination has reached an upper limit number which is greater than one and is predetermined for respective coin denominations, and acceptance inhibit means for inhibiting acceptance of a subsequently inserted coin of a specific one of said coin denominations when the number of the coins counted by the respective counter means has reached said preset upper limit number.

2. A control system for a vending machine as defined in claim 1 wherein said acceptance inhibit means comprises an accept-return control solenoid for guiding the inserted coin to a true coin path when energized and to a coin return path when de-energized, said solenoid being de-energized in response to detection of a coin of a denomination whose number counted has reached said preset upper limit and being energized in response to detection of a coin of a denomination whose counted number is detected as being below said preset upper limit for said coin denomination.

3. In a vending machine, a control system for limiting the acceptance of coins of different denominations to a preset limit in excess of one for each coin denomination, said coin control system comprising separate counter means for each coin denomination, separate means controlled by each of said counter means for detecting when a preselected number of each coin denomination is in said machine, and coin acceptance control means coupled to said detecting means for preventing the acceptance of a coin of a denomination when said detecting means for that particular coin denomination has detected that said preset limit has been reached.

4. The control system of claim 3 wherein said coin acceptance control means includes an AND circuit for each coin denomination, coin discriminating means for discriminating coin denominations coupled to each AND circuit as an input, and each AND circuit further receiving an input from a respective one of said detecting means.

5. The control system of claim 4 wherein a further AND circuit is coupled to and controls each of said counter means, each of said further AND circuits being coupled to a respective one of said first mentioned AND circuits for receiving an input therefrom, and there being an accepted coin detector circuit coupled to each of said further AND circuits as a second input.

* * * * *